US006003296A

United States Patent [19]

Citeno et al.

[11] Patent Number: 6,003,296

[45] Date of Patent: Dec. 21, 1999

[54] FLASHBACK EVENT MONITORING (FEM) PROCESS

[75] Inventors: Joseph Vincent Citeno, Niskayuna; Charles Evan Steber, Scotia; Christian L. Vandervort, Voorheesville, all of N.Y.; Donald Bruce Potter, Wilmington, Del.; Robert J. Iasillo, Ballston Spa, N.Y.

[73] Assignee: General Electric Co., Schenectady, N.Y.

[21] Appl. No.: 08/942,279

[22] Filed: Oct. 1, 1997

[51] Int. Cl.[6] ..... F02C 9/00

[52] U.S. Cl. ..... 60/39.02; 60/39.091

[58] Field of Search ..... 60/39.02, 39.03, 60/39.091

[56] References Cited

U.S. PATENT DOCUMENTS

| | | | |
|---|---|---|---|
| 3,635,018 | 1/1972 | Corso et al. | 60/39.091 |
| 4,292,801 | 10/1981 | Wilkes et al. . | |
| 4,845,952 | 7/1989 | Beebe . | |
| 4,966,001 | 10/1990 | Beebe . | |
| 5,107,673 | 4/1992 | Sato et al. | 60/39.02 |
| 5,235,814 | 8/1993 | Leonard . | |
| 5,327,718 | 7/1994 | Iwata et al. | 60/39.03 |
| 5,622,054 | 4/1997 | Tingle . | |
| 5,685,139 | 11/1997 | Mick et al. . | |
| 5,857,320 | 1/1999 | Amos et al. | 60/39.06 |

OTHER PUBLICATIONS

Chapter 8, GE Power Generation, 39$^{th}$ GE Turbine State–of–the Art Technology Seminar, "Dry Low $NO_x$ Combustion Systems for GE Heavy–Duty Gas Turbines", Davis et al. GER–3568F, Aug. 1996.

*Primary Examiner*—Charles G. Freay
*Attorney, Agent, or Firm*—Nixon & Vanderhye

[57] ABSTRACT

A method for detecting flashback events in gas turbine is disclosed. The method employs periodic reference point checks to determine whether or not flashback damage has occurred. The method relies on the repeatability of exhaust profile and NOx as functions of precise turbine conditions. In combination with experience-based limits, changes in these values are used to determine if a flashback has occurred, even days later.

34 Claims, 7 Drawing Sheets

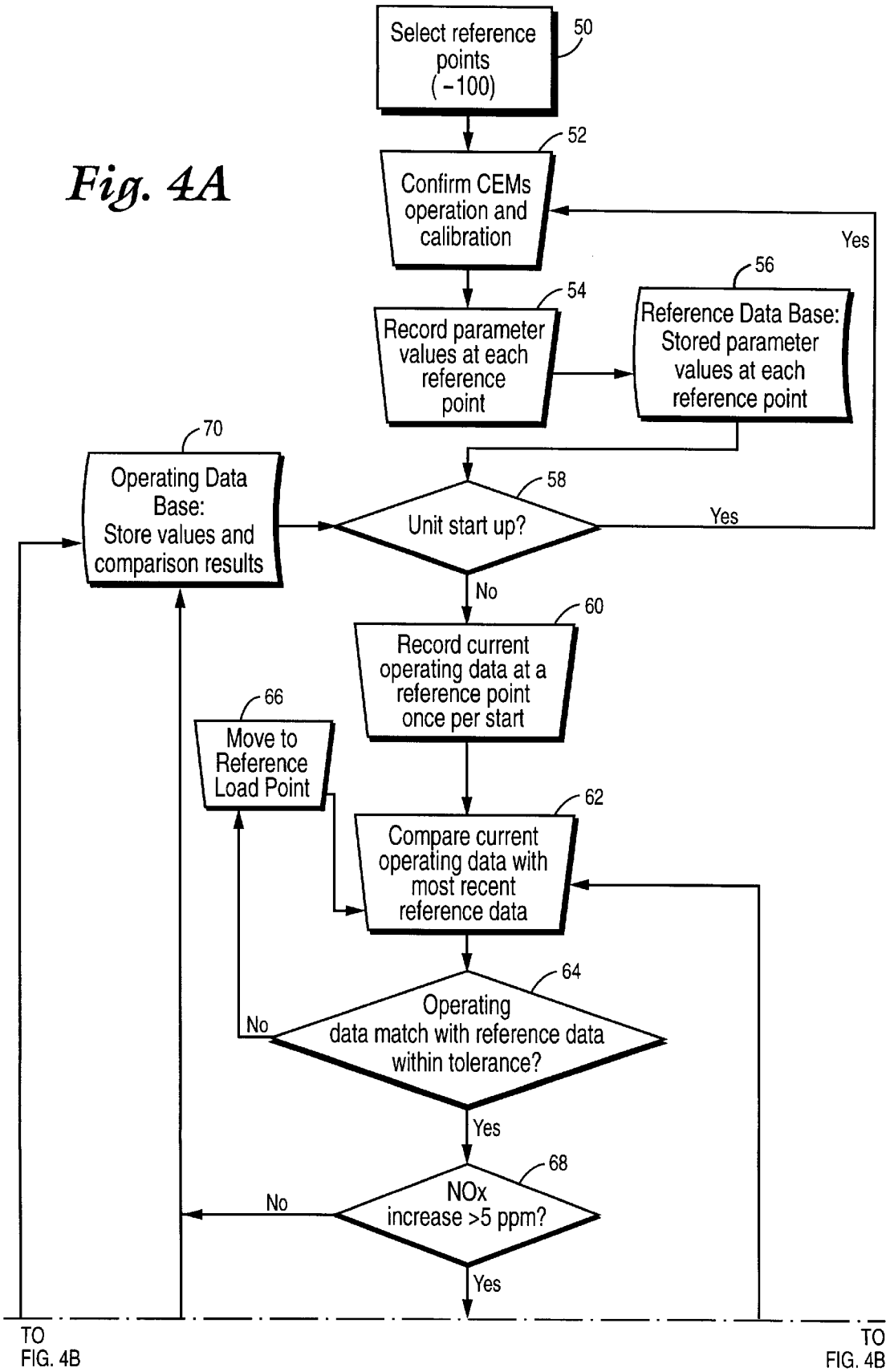
Fig. 4A
Select reference points (-100)
50
Confirm CEMs operation and calibration
52
Yes
Record parameter values at each reference point
54
Reference Data Base: Stored parameter values at each reference point
56
Operating Data Base: Store values and comparison results
70
Unit start up?
58
Yes
No
Record current operating data at a reference point once per start
60
Move to Reference Load Point
66
Compare current operating data with most recent reference data
62
Operating data match with reference data within tolerance?
64
No
Yes
NOx increase >5 ppm?
68
No
Yes
TO FIG. 4B
TO FIG. 4B

FLASHBACK EVENT MONITORING (FEM) PROCESS

BACKGROUND AND SUMMARY OF THE INVENTION (1) Field of Invention

The present invention relates to the detection of combustion system malfunctions in gas turbines, and more particularly, to a method for the early detection of gas-turbine combustor damage due to flashbacks so as to minimize subsequent hot-gas path damage and leakage of combustible gas into the turbine enclosure.

(2) Background Information

In recent years there has been an increase in the regulatory requirements for low emissions of pollutants, such as Oxides of Nitrogen (called NOx) from gas-turbine power plants. One method for controlling gas-turbine emissions is the use of a combustor design which limits the formation of pollutants in the burning zone by using lean-premixed combustion technology.

A gas-turbine combustor is essentially a device used for mixing large quantities of fuel and air and burning the resulting mixture. Gas-turbines with combustion systems designed to reduce NOx emissions to levels below 40 ppm without water or steam injection employ a combustion process in which fuel is uniformly mixed with air prior to the combustion process. In the premixing zone, ignition of the fuel and air occasionally occurs. This event, regardless of its cause, is usually called a "flashback". Due to the design of most premix systems, the combustion of fuel and air in the premix section usually causes considerable damage to components. For various reasons, it is often not practical to design a low NOx combustor to operate satisfactorily with flame in the premix section. To prevent damage in the event of a flashback, it is necessary to quickly shut-off the premixer fuel and inject the fuel into another fuel nozzle passage, if provided, or simply trip the machine.

Flashback damage has historically been detected using NOx emission and exhaust temperature spreads as indicators. When a flashback occurs, NOx increases and exhaust temperature spreads often, but not always, increase. The NOx increase is typically proportional to the severity of the flashback. On the other hand, the exhaust temperature spread change can vary, either decreasing or increasing, depending upon the state of the combustors, which suffer flashback, prior to the flashback event. The unpredictable behavior of exhaust temperature spreads, coupled with the emissions data scatter, has made it difficult to determine whether or not a flashback has occurred using NOx and exhaust spread indicators. NOx or spread changes alone are insufficient to indicate a flashback event. Methods which rely on changes in NOx and exhaust profile over sequential instants of time to determine if a flashback has occurred are ineffective because changes in NOx and exhaust profile can occur during loading. Therefore, any loading may appear to be a flashback using this method.

SUMMARY OF THE INVENTION

It is an object of the present invention to provide a method of detecting combustion system flashbacks in gas-firing turbines.

It is another object of the present invention to provide a method of detecting combustion system flachbacks which overcomes the drawbacks of methods using only NOx emission and exhaust temperature spreads as indicators of flashback damage.

It is a further object of the present invention to provide a method of detecting combustion system flashbacks which uses a comparison of operating data for a turbine to detect flashbacks.

The present invention is directed to a flashback event monitoring (FEM) process which advantageously employs periodic reference point checks to determine whether or not flashback damage has occurred. The process of the present invention compares current operating data taken at a selected number of operative reference points in a turbine with a set of reference data for that particular turbine previously taken at the same reference points. Changes in parameter values which exceed prescribed limits are characteristic of machine behavior after a flashback event. When these changes exceed the prescribed limits, action is taken to ascertain whether the change is a false indication or indicative of a flashback event. The FEM process also relies on the repeatability of exhaust profile and NOx as functions of precise turbine conditions. In combination with experience-based limits, changes in these values can be used to determine if a flashback has occurred.

The FEM process of the present invention allows the identification of several flashback events even days after they have occurred. The FEM process can be used manually by turbine operators or automated when used with industrial gas-turbine control systems. The process, in combination with such automation, permits flashback events to also be detected within minutes of occurrence. This allows a significant reduction in the risk of back-flow of combustion gases and potential turbine compartment explosions. A more detailed description of the present process is set forth below.

BRIEF DESCRIPTION OF THE DRAWINGS

FIGS. 4A and 4B are a flowchart of the FEM process of the present invention.

DESCRIPTION OF THE PREFERRED EMBODIMENT

Figure 1:
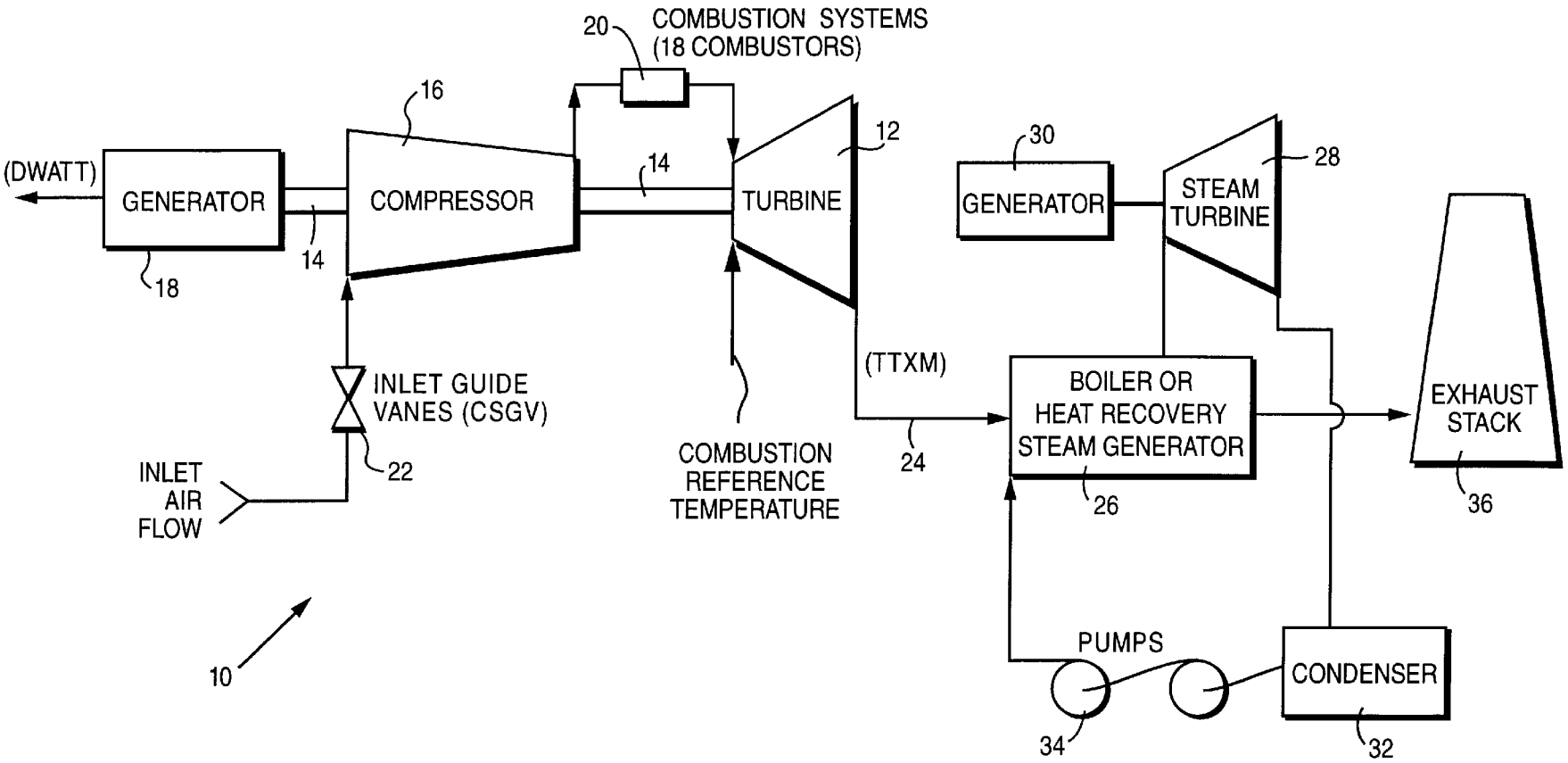
FIG. 1 is an example of a gas turbine combined cycle power plant represented in block diagram format.

FIG. 1 is a block diagram of a typical gas turbine combined cycle power plant 10. Plant 10 includes a gas turbine 12 connected by a shaft 14 to a compressor 16. Connected to the opposite end of compressor 16, also through shaft 14, is a generator 18 for producing electrical power. A combustion system 20, which may include from 6 to 18 combustors, is connected between compressor 16 and turbine 12. Airflow into compressor 16 is regulated by inlet guide vanes 22.

The exhaust from turbine 12, which is typically in the range of 1000° to 1200° F., is used to make steam for operating another turbine 28, which is a steam turbine that drives a generator 30 for generating additional electricity. The high temperature exhaust from turbine 12 is fed through duct 24 to a boiler or heat recovery steam generator 26. The heat from the exhaust is then used by boiler 26 to heat water into steam that turns steam turbine 28. The steam turning turbine 28 is then condensed into water in condenser 32 and returned by pumps 34 to boiler 26 to be used again. The exhaust from boiler 26 is then exhausted through exhaust stack 36.

The parameters monitored in the FEM process of the present invention are:

(1) Compressor Inlet Temperature (CTIM);

(2) Gas-Turbine Load (DWATT);

(3) Combustion Reference Temperature (TTRF1);

(4) Compressor Pressure Ratio (CPR);

(5) Inlet Guide Vane Angle (DGIV);

(6) NOx (upstream of SCR);

(7) Exhaust Temperature Spread (TTXSP1);

(8) Mean Turbine Exhaust Temperature (TTXM); and (9) Difference between individual thermocouple values and mean exhaust temperature (DTTX_1 . . . DTTX_n, . . . DTTX_31, where DTTX_n TTX_n–TTXM).

Each of these parameters are briefly discussed below.

The first parameter monitored, the Compressor Inlet Temperature (CTIM), is the temperature of the air flowing into compressor 16 from the outside. This air enters compressor 16 through large ducts (not shown) that can be forty feet by forty feet in size for industrial gas turbines. Thus, the compressor inlet temperature will vary as the outside air temperature varies.

The gas-turbine load (DWATT), the second parameter monitored, is the electrical energy produced by generator 18. While, this load will vary substantially for some machines, in most it will remain at base (i.e., full load), which is typically in the range of 40 to over 250 megawatts, depending on machine size.

The third parameter, the Combustion Reference Temperature (TTRF1), is a calculated value based on a well known function in the industry that uses such parameters as exhaust temperature, compressor discharge pressure and ambient temperature. This temperature is difficult to measure directly because it tends to be in the range of 2400° F.

The fourth parameter, Compressor Pressure Ratio (CPR), is the pressure out of compressor 16 divided by the pressure in. The pressure into compressor 16 is atmospheric, i.e., 14.7 psia, while the pressure out of compressor 16 is in the range of 220 psia.

The inlet guide vanes 22 shown in FIG. 1 is shown as a throttling valve on the inlet of compressor 16, which allows the mass flow through compressor 16 to be varied. The fifth parameter, Inlet Guide Vane Angle (IGVA), is a measure of the amount by which the inlet guide vanes 22 are rotated to throttle the compressor inlet. For one machine manufactured by General Electric Company, a GE Frame MS9001FA DLN-2 Gas Turbine, the inlet guide vanes 15 are typically 86° at full load and are modulated according to load to a minimum angle of 42° according to a specific schedule.

NOx, the sixth monitored parameter, is a product of combustion in gas-turbines. Gas turbines commonly produce two types of pollutants, NO and $NO_2$. NOx, or Oxides of Nitrogen, is a combination of the NO and $NO_2$. The NOx is measured for the FEM process in the exhaust duct 24 of turbine 12, or in the stack 36, if the heat recovery steam generator is not fitted with additional NOx reducing features. Although the preferred embodiment described below includes a NOx measurement as one of the parameters monitored in the FEM process, the process has and can be practiced without a NOx measurement. In this instance, the process described by the flowchart of FIGS. 4A and 4B would be substantially similar, except that the steps relating to the measuring of the NOx levels and the decisions based on the NOx levels would drop out.

Figure 2:
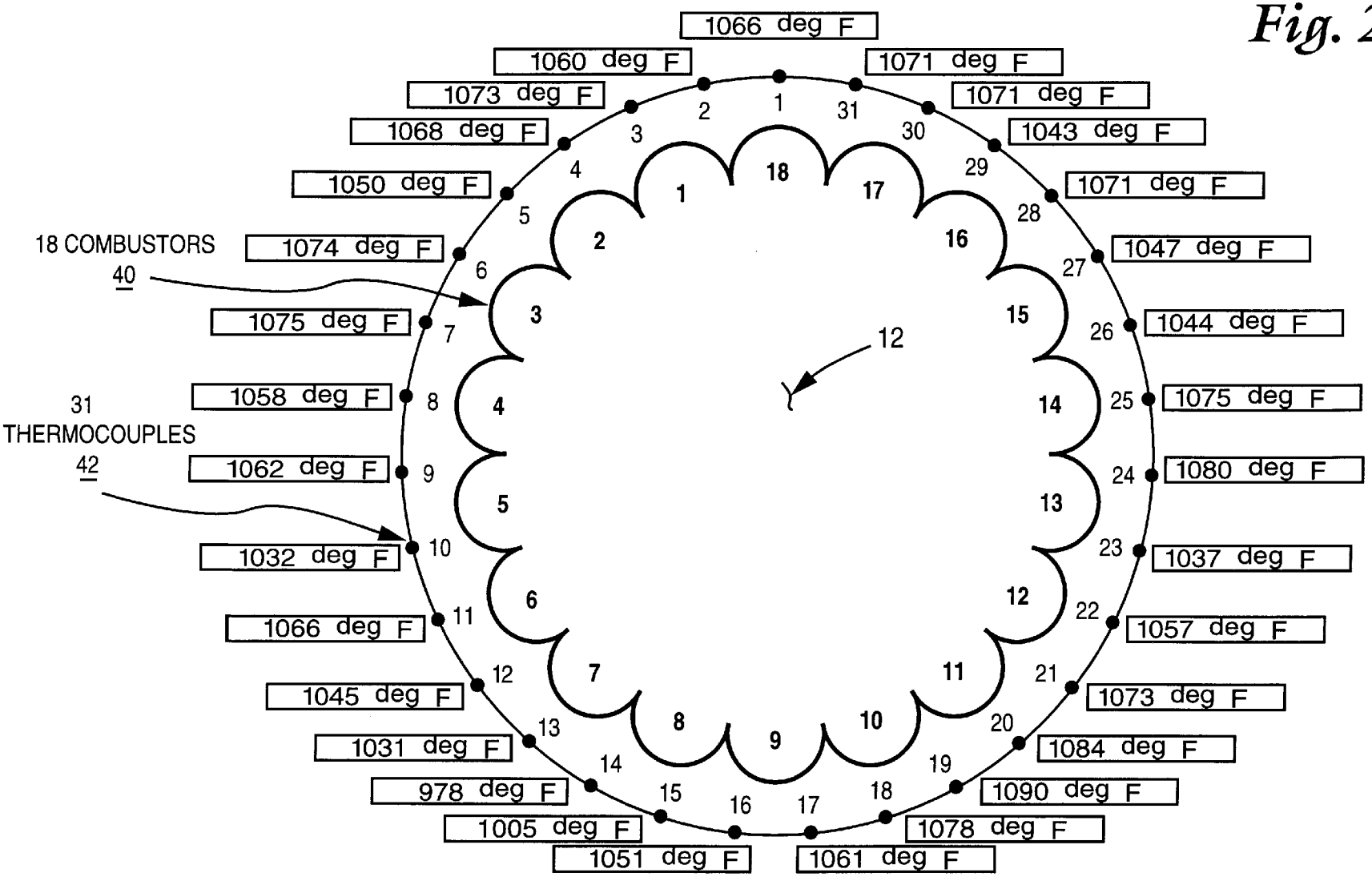
FIG. 2 is a simplified graphical depiction of the relative positioning between the combustors in a General Electric 9FA machine and the thermocouples measuring the temperatures of the exhaust gas exiting the machine's turbine.

The seventh parameter is exhaust temperature spread (TTXSP1). The 9FA gas turbine identified above uses a combustion system with eighteen distinct combustors 40 circumferentially positioned around the turbine 12. The turbine also includes thirty-one thermocouples 42, also circumferentially positioned around the exhaust of turbine 12. The FEM process uses these thermocouple measurements to ensure that the combustors 40 are operating properly. Each of the thirty-one thermocouples 42 has a distinct circumferential position in the exhaust of turbine 12, and each provides a temperature measurement that, with the other thermocouple measurements, serves to indicate the proper functioning of the combustion system 20. The relative positioning between the combustors and thermocouples is exemplified in FIG. 2, which is a simplified graphical depiction of such components. If one of the combustors were to receive less fuel, the result would be a cool spot that appears in the temperature measurements taken by the thermocouples 42. The bar graph shown in FIG. 3, which corresponds to the exhaust thermocouples 42 of turbine 12 shown in FIG. 2 at a different point in time, depicts a cool spot that is evidenced by the low temperature reading of 1030° F. for thermocouple 14.

Typically, when a machine is operating properly, the exhaust spread, i.e., the difference between the hottest temperature and the coldest temperature measured by the thermocouples 42, will be around 60° F. This spread indicates that all of the combustors are equally fueled and have nearly equal fuel/air ratios. If the temperature spread rises to a level of around 150° to 160° F., then such a spread indicates the existence of a combustor that is too hot or too cold, indicating a need to shut down or trip the unit as a protective measure.

The eighth parameter, Mean Turbine Exhaust Temperature (TTXM), is the arithmetic average of the 31 thermocouples, and is typically in the range of around 1100° F. at full load.

Figure 3:
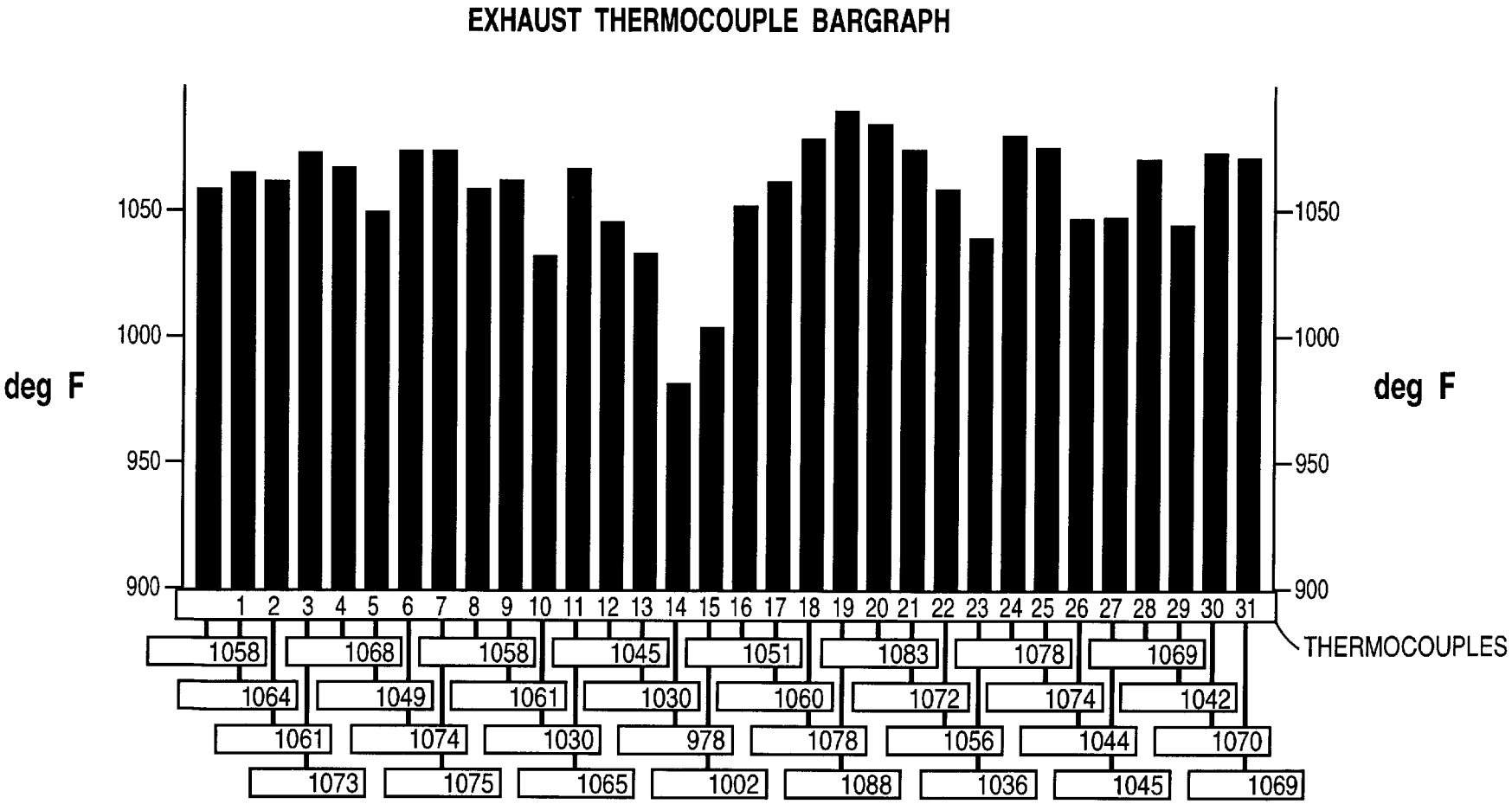
FIG. 3 is a bar graph of the individual thermocouple values (TTX_1, TTXn , . . . TTX_31) recorded by the thermocouples measuring the temperatures of the exhaust gas exiting the turbine of a General Electric 9FA machine.

The last parameter monitored by the FEM process are the differences between individual thermocouple values and the mean exhaust temperature. A plot of the temperatures of all of the thermocouples in the form of a bar graph produces a pattern, as shown in FIG. 3. When a unit is operating normally, this pattern should stay substantially the same for constant load and ambient temperature; however, changes in the pattern can be indicative of problems with individual combustors in the unit. The problem of greatest concern is a flashback, which causes changes in the exhaust temperature profile, as shown in FIG. 3.

Figure 4B:
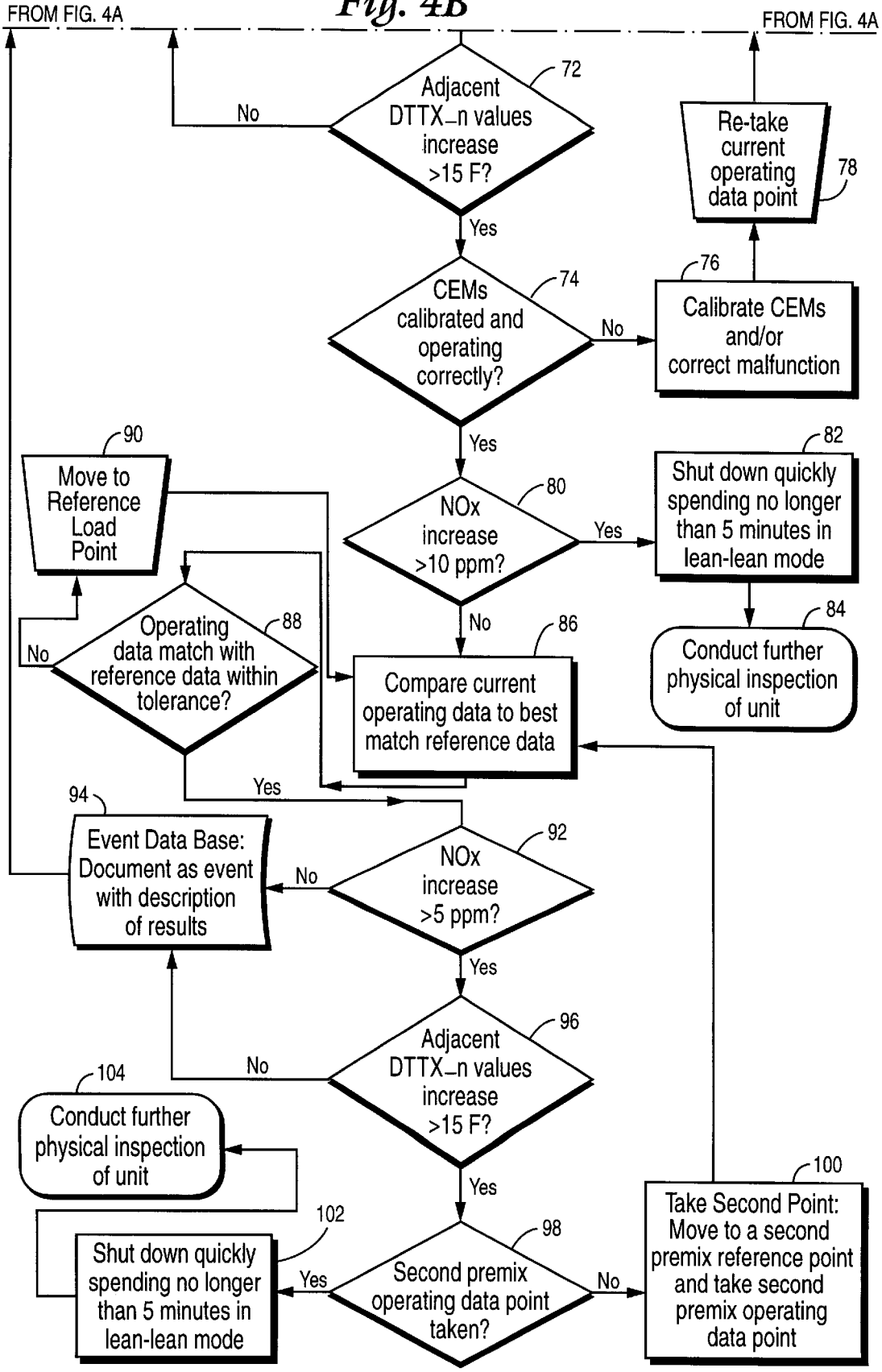

The process for monitoring the above identified parameters is illustrated in the flowchart show in FIGS. 4A and 4B. This flowchart can be the basis for a program that is used by an automatic process monitor for responding to flashback events.

Referring to FIGS. 4A and 4B, as indicated by step 50, the operating reference points for collecting data relating to the above-identified parameters must be selected. These reference points can be an array preferrably consisting of anywhere from one to one hundred reference points. This array of reference points is defined by the values of the combustion reference temperature (TTRF1), the gas-turbine load (DWATT) and the compressor ratio (CPR). The machine operating reference points are selected from the range of possible operating loads and ambient temperatures. Typical points would be 60, 80 and 100% of load at three typical ambient temperatures for a given site.

All data taken at these references points must be taken at steady load after being held for at least 5 minutes so that emissions from the turbine combustors are stable. The reference point parameters can be taken manually or with an automatic data collection system.

As shown in step 52, for the process of the present invention to be effective, proper CEMs calibration and maintenance must first be confirmed. A CEM is a continuous emissions monitoring system which provides a measure of NOx emissions.

Whether an array of one, one hundred or some other number of reference points is used depends on how a unit is normally operated. If a unit is operated most of the time at base load, then three reference points are probably adequate, although one point might suffice. Conversely, if a unit is operated at many different load points, then a greater number of reference points would be desirable. For example, if a unit is operating at several different loads, e.g., 50% of load, 75% of load, 90% of load and 100% of load, there would be a reference point for each percent increment. Each reference point would have its own distinct set of the nine parameters identified above. Most commonly, four to nine reference points are used with most machines.

Tolerance bands are determined for all nine parameters to define a reference point window for each reference point. Tolerance bands are determined based on the stability of the type or gas turbine being monitored.

Two examples of parameter data for the 9FA machine identified above, which were taken at loads of about 180 megawatts and 220 megawatts, are shown in Tables 1 and 2 below, respectively.

TABLE 1

| POINTNAME | VALUE | UNITS |
|---|---|---|
| CTIM | 64 | deg F |
| DWATT | 179.8 | MW |
| TTRF1 | 2258 | deg F |
| CPR | 13.01 | prs_R |
| DGIV | 69.7 | DGA |
| NOx | 19.4 | ppm |
| TTXSP1 | 88 | deg F |
| TTXM | 1101 | deg F |

TABLE 2

| POINTNAME | VALUE | UNITS |
|---|---|---|
| CTIM | 70 | deg F |
| DWATT | 219.5 | MW |
| TTRF1 | 2347 | deg F |
| CPR | 14.59 | prs_R |
| DGIV | 83.6 | DGA |
| NOx | 40.1 | ppm |
| TTXSP1 | 70 | deg F |
| TTXM | 1116 | deg F |

Figure 5:
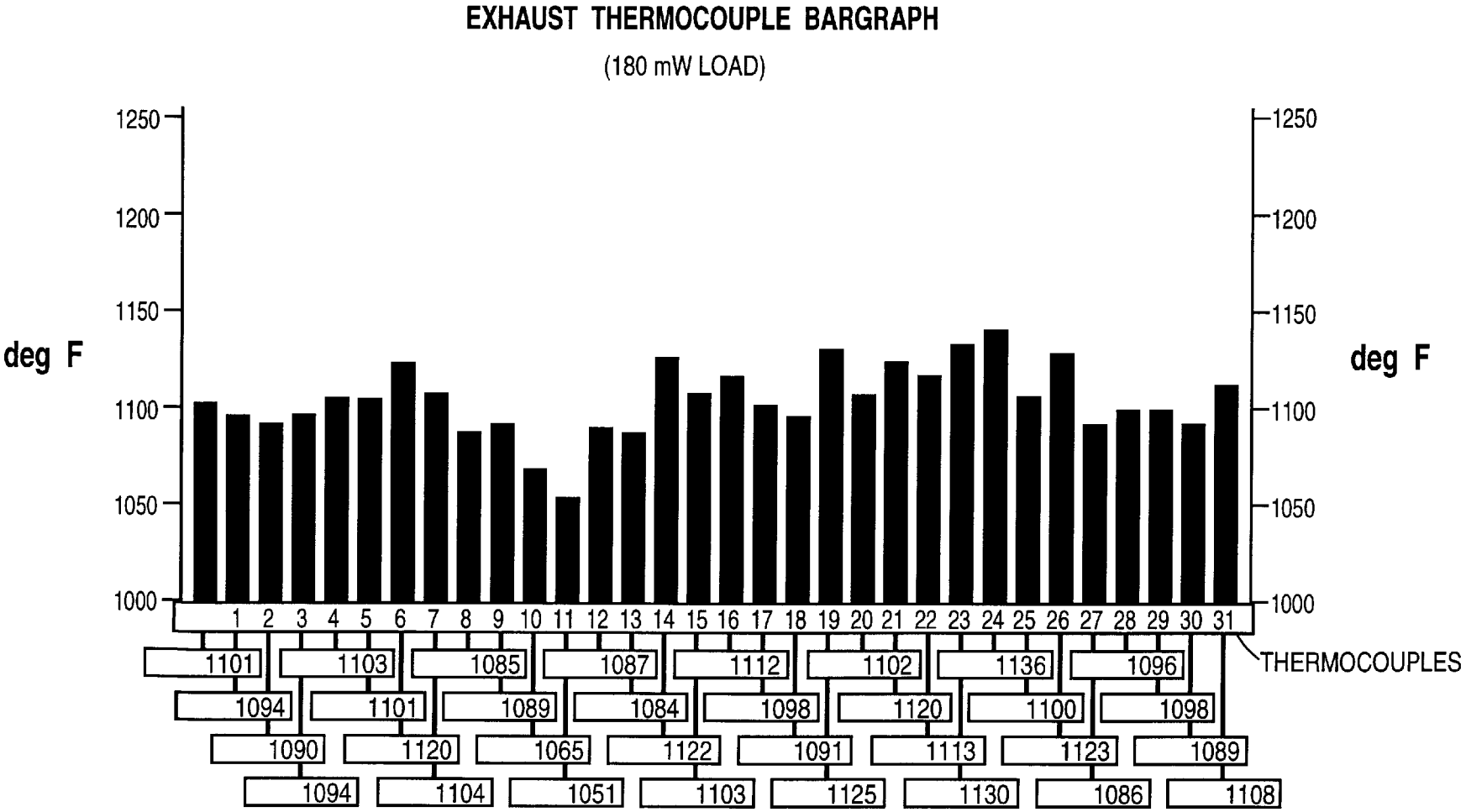
FIG. 5 is a bar graph of the individual thermocouple values (TTX_1, TTXn, . . . TTX_31) recorded by the thermocouples measuring the temperatures of the exhaust gas exiting the turbine for a General Electric 9FA machine operating at a load of about 180 megawatts.
Figure 6:
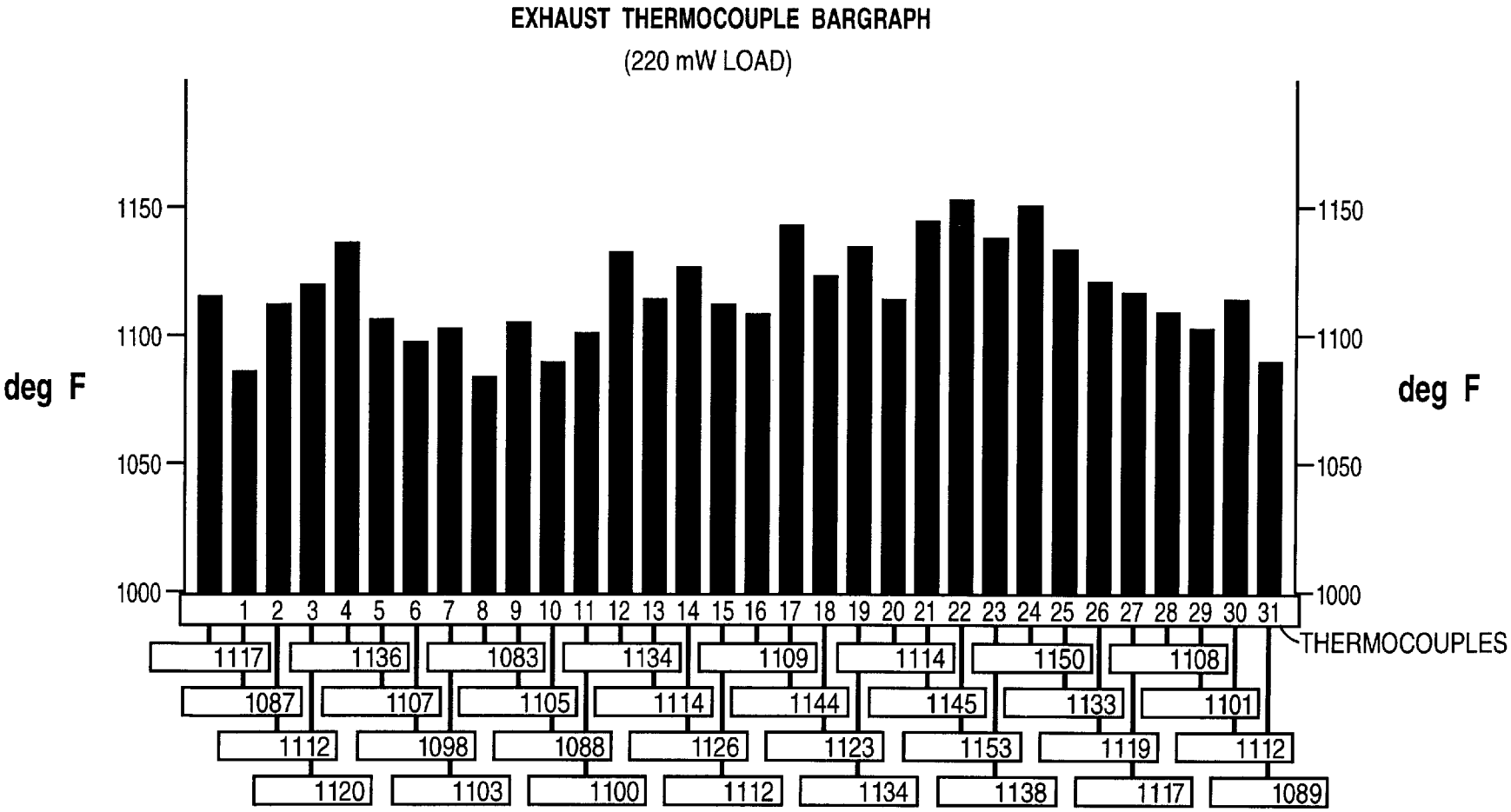
FIG. 6 is a bar graph of the individual thermocouple values (TTX_1, TTXn, . . . TTX_31) recorded by the thermocouples measuring the temperatures of the exhaust gas exiting the turbine for a General Electric 9FA machine operating at a load of about 220 megawatts.

The individual thermocouple values (TTX_1, TTXn, . . . TTX_31) corresponding to these two loads are shown in FIGS. 5 and 6, respectively.

The next step 54 is to record the nine parameter values for each reference point. All reference point measurements must be taken with the unit in premixed steady-mode (PMSS) with Inlet Guide Vane (IGV) Temperature Control "ON", and, if available, Inlet Bleed Heat (IBH) "ON". These switches can be set on a site by site basis.

As shown in step 54, at each reference point the values of the parameters listed above are recorded. This data becomes a part of a turbine specific reference data set as shown in step 56. During each machine restart, additional turbine specific reference data can be taken to build a larger reference data base. Thus, referring to step 58, if the turbine unit is starting up, the process jumps back to step 52 to confirm CEMs operation and then record parameter values at each reference point, as in step 54. Such data is then placed in the reference data base, as in step 56.

If the unit is not starting up at step 58, the process jumps to step 60 where current operating data is recorded at each reference point, after which the current operating data at step 62 is compared with the most recent reference data. If, at step 64, it is determined that such data do not match within tolerance, then the machine load is adjusted, at step 66, to the load point where the most recent reference data was recorded. Thereafter, the data comparison at step 62 is repeated. If there is a data match, then the process moves onto step 68.

At step 68, a determination is made as to whether the NOx level has increased by an amount greater than a specified NOx limit, identified hereinafter for ease of reference as NOx Limit 1. NOx Limit 1 is typically 5 ppm. If not, the current operating data and comparison results are stored, at step 70, in the operating data base, after which a determination is again made at step 58 as to whether there is a unit start up. If not, current operating data is recorded and compared to the most recent reference data, as in steps 60, 62 and 64, after which NOx increase is again evaluated at step 68. The parameter values recorded in step 60 are recorded in set time intervals at one of the reference points within the reference point window.

If, at step 68, it is determined that the NOx value increased by more than NOx Limit 1, the method jumps to step 72, where it is determined if two or more adjacent thermocouple values (DTTX_n) increased by an amount greater than a specified thermocouple change limit, identified hereinafter for ease of reference as T/C Change Limit 1. T/C Change Limit 1 is typically 15° F. If the two adjacent thermocouple values have not increased more than T/C Change Limit 1, then the method jumps back to step 70, where the operating data and the comparison results are stored in the operating database before the method jumps back to step 58.

If the NOx value has increased by more than NOx Limit 1 and two or more adjacent thermal couple values have increased by T/C Change Limit 1, then the method moves to step 74 where proper CEMs operation and calibration are confirmed. If CEMs is malfunctioning, or out of calibration, then the method moves to step 76 to correct the CEMs problem, after which current operating data is retaken at step 78. Thereafter, the method moves back to steps 62 and 64 where the current operating data is compared with the most recent reference data. The method then ascertains, at steps 68 and 72, whether there have been increases in the NOx value and adjacent thermocouple values (DTTX_n), as described above.

If the CEMs is calibrated and operating properly, then the process moves to step 80 where the determination is made as to whether the NOx value has increased by more than an amount greater than a second specified NOx limit, identified hereinafter for ease of reference as NOx Limit 2. If it has, then the unit is shut down quickly, at step 82, after which a physical inspection of the suspected combustors is made at step 84 to determine whether a flashback event has occurred. The inspection is usually performed using a fiber optic borescope or other viewing system. The other option is to perform the inspection after disassembling the suspected combuster 20.

If the NOx value has not increased by an amount greater than NOx Limit 2, then the reference data base is perused to find a referenced data set more closely matched to the ambient, load and TTRF1 conditions of the current operating data, as in step 86 of the flow chart of FIG. 4B. This data is called the "best match reference data". The parameter values of the current operating data are then compared, at step 88, with the parameter values of the best match reference data. If it is determined at step 88 that such data do not match within tolerance, then the machine is again shifted, at step 90, to a different reference load point where a best match reference data is within tolerance. Thereafter, the data comparison at step 86 is repeated. If there is a match, the process moves onto step 92.

If the NOx value has increased by more than NOx Limit 1, as in step 92 of the flowchart of FIG. 4B, and if two or more adjacent DDTX_n values have increased by more than T/C Change Limit 1, as in step 96, then the machine is loaded, at steps 98 and 100, to a second premixed reference point, and a second premix reference point comparison is performed with best matched reference data from the second premixed reference point, as indicated in steps 86 and 88. If the NOx value has increased by more than NOx Limit 1 and two or more adjacent DTTX_n values increase more than T/C Change Limit 1, and if it is determined at step 98 that the machine has been loaded to a second premix reference point, then the unit is shut down, as in step 102, again spending no more than five minutes in lean-lean mode, to allow further physical inspection the unit, as in step 104 to determine whether a flashback event has occurred.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A method of detecting flashback events in a gas turbine power plant, said plant including a turbine, a combustion system, a compressor and a generator, said method comprising:

selecting at least one operating reference point at which to measure data for certain predetermined operating parameters of said gas turbine power plant, measuring and storing said data for said predetermined operating parameters at each of said reference points, measuring current data for said operating parameters, determining whether said current data matches, within a predetermined tolerance amount, data for said predetermined operating parameters that is most recently stored, if said current data matches said most recently stored data within said predetermined tolerance amount, determining whether said turbine's NOx emissions have increased by a first predetermined amount and whether said turbine's exhaust profile has changed by a second predetermined amount, and if said turbine's NOx emissions have increased by said first predetermined amount and said turbine's exhaust profile has changed by said second predetermined amount, inspecting said turbine to confirm that said flashback event has occurred.

2. The method of claim 1 wherein said turbine's exhaust profile is measured by a plurality of thermocouples and said second predetermined amount is an increase by any adjacent two of said plurality of thermocouples by a predetermined temperature.

3. The method of claim 2 wherein said first predetermined amount is about 10 parts per million and said predetermined temperature is about 15 degrees Fahrenheit.

4. The method of claim 1 wherein said stored and current data for said predetermined operating parameters is measured at steady load after said plant has been held at said load for at least a predetermined amount of time.

5. The method of claim 1 wherein said predetermined operating parameters include: said compressor's inlet temperature, said generator's load, combustion reference temperature, pressure out of said compressor divided by pressure into said compressor, an angle of a set of inlet guide vanes of said compressor, said NOx emissions from said turbine, temperature spread between a hottest temperature and a coldest temperature generated by a plurality of combustors located in said combustion system, mean exhaust temperature of said turbine, and differences between temperature values measured by each of a plurality of thermocouples located in said turbine's exhaust and said mean exhaust temperature of said turbine.

6. The method of claim 1 wherein a plurality of reference points are selected at which to measure said data for said predetermined operating parameters.

7. The method of claim 1 wherein said at least one operating reference point is in the range of 1 to 100 inclusive.

8. The method of claim 1 further comprising:

determining whether said turbine's NOx emissions have increased by a third predetermined amount, confirming proper operation of said plant's emissions monitoring system, if said turbine's NOx emissions have increased by said third predetermined amount, and if said monitoring operation is proper, then making said determination as to whether said turbine's NOx emissions have increased by said first predetermined amount.

9. The method of claim 8 wherein said first predetermined amount is greater than said third predetermined amount.

10. The method of claim 8 wherein said first predetermined amount is about 10 parts per million and said third predetermined amount is about 5 parts per million.

11. The method of claim 8 wherein said turbine's exhaust profile is measured by a plurality of thermocouples and said second predetermined amount is an increase by any adjacent two of said plurality of thermocouples by a predetermined temperature.

12. The method of claim 11 wherein said predetermined temperature is about 15 degrees Fahrenheit.

13. The method of claim 8 wherein said stored and current data for said predetermined operating parameters is measured at steady load after said plant has been held at said load for at least a predetermined amount of time.

14. The method of claim 8 wherein said predetermined operating parameters include: said compressor's inlet temperature, said generator's load, combustion reference temperature, pressure out of said compressor divided by pressure into said compressor, an angle of a set of inlet guide vanes of said compressor, said NOx emissions from said turbine, temperature spread between a hottest temperature and a coldest temperature generated by a plurality of combustors located in said combustion system, mean exhaust temperature of said turbine, and, differences between temperature values measured by each of a plurality of thermocouples located in said turbine's exhaust and said mean exhaust temperature of said turbine.

15. The method of claim 8 wherein a plurality of reference points are selected at which to measure said data for said predetermined operating parameters.

16. The method of claim 8 wherein said at least one operating reference point is in the range of 1 to 100 inclusive.

17. The method of claim 1 further comprising:

storing said data for said predetermined operating parameters at each of said reference points in a data base corresponding to said gas turbine power plant, if said turbine's NOx emissions have not increased by said first predetermined amount and said turbine's exhaust profile has not changed by said second predetermined amount, determining whether said current data more closely matches, within said predetermined tolerance amount, second stored data for said predetermined operating parameters than said most recently stored data does, and if said current data matches said second stored data within said predetermined tolerance amount, determining whether said turbine's NOx emissions have increased by a third predetermined amount and whether said turbine's exhaust profile has changed by said second predetermined amount, if said turbine's NOx emissions have increased by said third predetermined amount and said turbine's exhaust profile has changed by said second predetermined amount, measuring second current data for said operating parameters at a second reference point, determining whether said second current data matches, within a predetermined tolerance amount, said second stored data within said predetermined tolerance amount, if said second current data matches said second stored data within said predetermined tolerance amount, determining whether said turbine's NOx emissions have increased by said third predetermined amount and whether said turbine's exhaust profile has changed by a second predetermined amount, and if said turbine's NOx emissions have increased by said third predetermined amount and said turbine's exhaust profile has changed by said second predetermined amount, conducting said inspection of said turbine to confirm that said flashback event has occurred.

18. The method of claim 17 wherein said first predetermined amount is about 10 parts per million and said second predetermined amount is about 15 degrees Fahrenheit.

19. The method of claim 17 wherein said stored and current data for said predetermined operating parameters is measured at steady load after said plant has been held at said load for at least a predetermined amount oftime.

20. The method of claim 17 wherein said predetermined operating parameters include: said compressor's inlet temperature, said generator's load, combustion reference temperature, pressure out of said compressor divided by pressure into said compressor, an angle of a set of inlet guide vanes of said compressor, said NOx emissions from said turbine, temperature spread between a hottest temperature and a coldest temperature generated by a plurality of combustors located in said combustion system, mean exhaust temperature of said turbine, and differences between temperature values measured by each of a plurality of thermocouples located in said turbine's exhaust and said mean exhaust temperature of said turbine.

21. The method of claim 17 wherein a plurality of reference points are selected at which to measure said data for said predetermined operating parameters.

22. The method of claim 17 wherein said at least one operating reference point is in the range of 1 to 100 inclusive.

23. A method of detecting flashback events in a gas turbine power plant, said plant including a turbine, a combustion system, a compressor and a generator, said method comprising:

selecting at least one operating reference point at which to measure data for certain predetermined operating parameters of said gas turbine power plant, measuring and storing said data for said predetermined operating parameters at each of said reference points, storing said data for said predetermined operating parameters at each of said reference points in a data base corresponding to said gas turbine power plant, measuring current data for said operating parameters, determining whether said current data matches, within a predetermined tolerance amount, data for said predetermined operating parameters that is most recently stored, if said current data matches said most recently stored data within said predetermined tolerance amount, determining whether said turbine's NOx emissions have increased by an initial predetermined amount and whether said turbine's exhaust profile has changed by a predetermined temperature, if said turbine's NOx emissions have increased by said initial predetermined amount and said turbine's exhaust profile has changed by said predetermined temperature, confirming proper operation of said plant's emissions monitoring system, if said monitoring operation is proper, determining if said turbine's NOx emissions have increased by a subsequent predetermined amount, if said turbine's NOx emissions have increased by said subsequent predetermined amount, conducting said inspection of said turbine to confirm that said flashback event has occurred, if said turbine's NOx emissions have not increased by said initial predetermined amount and said turbine's exhaust profile has not changed by said predetermined temperature, determining whether said current data more closely matches, within said predetermined tolerance amount, second stored data for said predetermined operating parameters than said most recently stored data does, if said current data matches said second stored data within said predetermined tolerance amount, determining whether said turbine's NOx emissions have increased by said initial predetermined amount and whether said turbine's exhaust profile has changed by said predetermined temperature, if said turbine's NOx emissions have increased by said initial predetermined amount and said turbine's exhaust profile has changed by said predetermined temperature, measuring second current data for said operating parameters at a second reference point, determining whether said second current data matches, within a predetermined tolerance amount, said second stored data within said predetermined tolerance amount, if said second current data matches said second stored data within said predetermined tolerance amount, determining whether said turbine's NOx emissions have increased by said initial predetermined amount and whether said turbine's exhaust profile has changed by said predetermined temperature, and if said turbine's NOx emissions have increased by said initial predetermined amount and said turbine's exhaust profile has changed by said predetermined temperature, conducting said inspection of said turbine to confirm that said flashback event has occurred.

24. The method of claim 23 wherein said subsequent predetermined amount is greater than said initial predetermined amount.

25. The method of claim 24 wherein said subsequent predetermined amount is about 10 parts per million and said initial predetermined amount is about 5 parts per million.

26. The method of claim 23 wherein said turbine's exhaust profile is measured by a plurality of thermocouples and where the step of determining whether said turbine's NOX emissions have increased is performed by determining if values of any adjacent two of said plurality of thermocouples have increased by said predetermined temperature.

27. The method of claim 26 wherein said predetermined temperature is about 15 degrees Fahrenheit.

28. The method of claim 23 wherein said stored and current data for said predetermined operating parameters is measured at steady load after said plant has been held at said load for at least a predetermined amount of time.

29. The method of claim 23 wherein said predetermined operating parameters include: said compressor's inlet temperature, said generator's load, combustion reference temperature, pressure out of said compressor divided by pressure into said compressor, an angle of a set of inlet guide vanes of said compressor, said NOx emissions from said turbine, temperature spread between a hottest temperature and a coldest temperature generated by a plurality of combustors located in said combustion system, mean exhaust temperature of said turbine, and differences between temperature values measured by each of a plurality of thermocouples located in said turbine's exhaust and said mean exhaust temperature of said turbine.

30. The method of claim 23 wherein a plurality of reference points are selected at which to measure said data for said predetermined operating parameters.

31. The method of claim 23 wherein said at least one operating reference point is in the range of 1 to 100 inclusive.

32. A method of detecting flashback events in a gas turbine power plant, said plant including a turbine, a combustion system, a compressor and a generator, said method comprising:

selecting at least one operating reference point at which to measure data for certain predetermined operating parameters of said gas turbine power plant, measuring and storing said data for said predetermined operating parameters at each of said reference points, measuring current data for said operating parameters, determining whether said current data matches, within a predetermined tolerance amount, data for said predetermined operating parameters that is most recently stored, if said current data matches said most recently stored data within said predetermined tolerance amount, determining whether said turbine's exhaust profile has changed by a predetermined amount, and if said turbine's exhaust profile has changed by said predetermined amount, inspecting said turbine to confirm that said flashback event has occurred.

33. The method of claim 32 wherein said predetermined operating parameters include: said compressor's inlet temperature, said generator's load, combustion reference temperature, pressure out of said compressor divided by pressure into said compressor, an angle of a set of inlet guide vanes of said compressor, temperature spread between a hottest temperature and a coldest temperature generated by a plurality of combustors located in said combustion system, mean exhaust temperature of said turbine, and differences between temperature values measured by each of a plurality of thermocouples located in said turbine's exhaust and said mean exhaust temperature of said turbine.

34. The method of claim 32 further comprising:

storing said data for said predetermined operating parameters at each of said reference points in a data base corresponding to said gas turbine power plant, if said turbine's exhaust profile has not changed by said predetermined amount, determining whether said current data more closely matches, within said predetermined tolerance amount, second stored data for said predetermined operating parameters than said most recently stored data does, and if said current data matches said second stored data within said predetermined tolerance amount, determining whether said turbine's exhaust profile has changed by said predetermined amount, if said turbine's exhaust profile has changed by said predetermined amount, measuring second current data for said operating parameters at a second reference point, determining whether said second current data matches, within a predetermined tolerance amount, said second stored data within said predetermined tolerance amount, if said second current data matches said second stored data within said predetermined tolerance amount, determining whether said turbine's exhaust profile has changed by said predetermined amount, and if said turbine's exhaust profile has changed by said predetermined amount, conducting said inspection of said turbine to confirm that said flashback event has occurred.

* * * * *